US007248711B2

(12) United States Patent
Allegro et al.

(10) Patent No.: US 7,248,711 B2
(45) Date of Patent: Jul. 24, 2007

(54) METHOD FOR FREQUENCY TRANSPOSITION AND USE OF THE METHOD IN A HEARING DEVICE AND A COMMUNICATION DEVICE

(75) Inventors: Silvia Allegro, Oetwil am See (CH); Olegs Timms, Zurich (CH); Adam Hersbach, The Patch (AU); Hugh McDermott, Mt. Macedon (AU); Evert Dijkstra, Fontaines (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 10/794,912

(22) Filed: Mar. 5, 2004

(65) Prior Publication Data

US 2004/0264721 A1 Dec. 30, 2004

Related U.S. Application Data

(63) Continuation-in-part of application No. 10/383,142, filed on Mar. 6, 2003, now abandoned.

(51) Int. Cl.
*H04R 25/00* (2006.01)

(52) U.S. Cl. ..... 381/316; 381/317; 381/320

(58) Field of Classification Search ..... 381/316, 381/318, 320, 321, 317, 60, 98, 94.2, 94.3, 381/106

See application file for complete search history.

(56) References Cited

U.S. PATENT DOCUMENTS

| | | | | |
|---|---|---|---|---|
| 4,982,434 A | | 1/1991 | Lenhardt | |
| 5,394,475 A | * | 2/1995 | Ribic | 381/316 |
| 6,577,739 B1 | * | 6/2003 | Hurtig et al. | 381/316 |

FOREIGN PATENT DOCUMENTS

| | | |
|---|---|---|
| EP | 0 054 450 A | 6/1982 |
| WO | 99/14986 A | 3/1999 |
| WO | 00/75920 A | 12/2000 |

OTHER PUBLICATIONS

Xuedong Huang, Alex Acero, Hsiao-Wuen Hon: "Spoken Language Processing" 2001, Prentice Hall Ptr, Upper Saddle River, New Jersey XP002248543, ISBN: 0-13-022616-5, p. 29, line 1—p. 36, line 8.

* cited by examiner

*Primary Examiner*—Curtis Kuntz
*Assistant Examiner*—Tuan Duc Nguyen
(74) *Attorney, Agent, or Firm*—Pearne & Gordon LLP

(57) ABSTRACT

A method for frequency transposition in a communication device Or a hearing device, respectively, is disclosed by transforming an acoustical signal into an electrical signal (s) and by transforming the electrical signal from time domain into frequency domain to obtain a spectrum (S). A frequency transposition is being applied to the spectrum (S) in order to obtain a transposed spectrum (S'), whereby the frequency transposition is being defined by a nonlinear frequency transposition function. Thereby, it is possible to transpose lower frequencies almost linearly, while higher frequencies are transposed more strongly. As a result thereof, harmonic relationships are not distorted in the lower frequency range, and at the same time, higher frequencies can be moved to a lower frequency range, namely to an audible frequency range of the hearing impaired person. The transposition scheme can be applied to the complete signal spectrum without the need for switching between non-transposition and transposition processing for different parts of the signal. Therefore, no artifacts due to switching are encountered. A higher transmission quality is obtained because more information is taken into account for the transmission.

24 Claims, 5 Drawing Sheets

| | | | | | | | | | |
|---|---|---|---|---|---|---|---|---|---|
| 1 | 0.9 | | | | | | | | |
| | 0.1 | 0.6 | 0.2 | 0.1 | | | | | |
| | | 0.4 | 0.8 | 0.9 | 0.3 | 0.1 | | | |
| | | | | | 0.7 | 0.9 | 0.8 | 0.6 | 0.5 |
| | | | | | | | 0.2 | 0.4 | 0.5 |
| | | | | | | | | | |
| | | | | | | | | | |
| | | | | | | | | | |
| | | | | | | | | | |
| | | | | | | | | | |

FREQUENCY

Bin_OUT

Bin_IN

FREQUENCY

*Fig. 7*

| | | | | | | | | | |
|---|---|---|---|---|---|---|---|---|---|
| 1 | | | | | | | | | |
| | 1 | | | | | | | | |
| | | 1 | | | | | | | |
| | | | 1 | | | | | | |
| | | | | 1 | 0.9 | | | | |
| | | | | | 0.1 | 0.6 | 0.2 | 0.1 | |
| | | | | | | 0.4 | 0.8 | 0.9 | 0.3 |
| | | | | | | | | | 0.7 |
| | | | | | | | | | |
| | | | | | | | | | |

FREQUENCY

Bin_OUT

Bin_IN

FREQUENCY

*Fig. 8*

METHOD FOR FREQUENCY TRANSPOSITION AND USE OF THE METHOD IN A HEARING DEVICE AND A COMMUNICATION DEVICE

FIELD OF THE INVENTION

The present invention relates to a method for frequency transposition in a hearing device to improve intelligibility of severely hearing impaired patients. The same method is applied in a communication device to improve transmission quality. In the technical field of hearing devices, the present invention is in particular suitable for a binaural hearing device. Furthermore, a hearing device as well as a communication device is also disclosed.

BACKGROUND OF THE INVENTION

Numerous frequency-transposition schemes for the presentation of audio signals via hearing devices for people with a hearing impairment have been developed and evaluated over many years. In each case, the principal aim of the transposition is to improve the audibility and discriminability of signals in a particular frequency range by modifying those signals and presenting them at other frequencies. Usually, high frequencies are transposed to lower frequencies where hearing device users typically have better hearing ability. However, various problems have limited the successful application of such techniques in the past. These problems include technological limitations, distortions introduced into the sound signals by the processing schemes employed, and the absence of methods for identifying suitable candidates and for fitting frequency-transposing hearing aids to them using appropriate objective rules.

The many techniques for frequency transposition reported previously can be subdivided into three broad types: frequency shifting, frequency compression, and reducing the playback speed of recorded audio signals while discarding portions of the signal in order to preserve the original duration.

Among frequency compression schemes, many linear and non-linear techniques including FFT/IFFT processing, vocoding, and high-frequency envelope transposition followed by mixing with unmodified low-frequency components have been investigated. Since harmonic patterns and formant relations are known to be important in the accurate perception of speech, it is also helpful to distinguish spectrum-preserving techniques from spectrum-destroying techniques. Each of these techniques is summarized briefly below.

At present, the only frequency-transposing hearing instruments available commercially are those manufactured by AVR Ltd., a company based in Israel and Minnesota, USA (see http://www.avrsono.com). An instrument produced previously by AVR, known as the TranSonic, has been superseded recently by the ImpaCt and Logicom-20 devices. All of these frequency-transposition instruments are based on the selective reduction of the playback speed of recorded audio signals. This is achieved by first sampling the input sound signal at a particular rate, and then storing it in a memory. When the recorded signal is subsequently read out of the memory, the sampling rate is reduced when frequency-lowering is required. Because the sampling rate can be changed, it is possible to apply frequency lowering selectively. For example, different amounts of frequency-lowering can be applied to voiced and unvoiced speech components. The presence of each type of component in the input signal is determined by estimating the spectral shape; the signal is assumed to be unvoiced when a spectral peak is detected at frequencies above 2.5 kHz, voiced otherwise. In order to maintain the original duration of the signals, parts of the sampled data in the memory are discarded when necessary. U.S. Pat. No. 5,014,319 assigned to AVR describes not only the compression of input frequencies (i.e. frequencies are transposed into lower ranges) but also frequency expansion (i.e. transposition into higher frequency ranges). Other similar methods of frequency transposition by means of reducing the playback speed of recorded audio signals have also been reported previously (e.g. FR-2 364 520, DE-17 62 185). As mentioned, a major problem with any of these schemes is that portions of the input signal must be discarded when the playback speed is reduced (to compress frequencies) in order to maintain the original signal duration, which is essential in a real-time assistive listening system such as a hearing device. This could result in audible distortions in the output signal and in some important sound information being inaudible to the hearing device user.

Linear frequency compression by means of Fourier Transform processing has been investigated by Turner and Hurtig at the University of Iowa, USA (Turner, C. W. and R. R. Hurtig: "Proportional Frequency Compression of Speech for Listeners with Sensorineural Hearing Loss", Journal of the Acoustical Society of America, vol. 106(2), pp. 877–886, 1999), and has led to an international patent application having the publication number WO 99/14 986. This real-time algorithm is based on the Fast Fourier Transform (FFT). Input signals are converted into the frequency domain by an FFT having a relatively large number of frequency bins resulting in a high frequency resolution which is absolutely necessary to achieve a good sound quality with a system based on linear frequency compression. To achieve frequency lowering, the reported algorithm multiplies each frequency bin by a constant factor (less than 1) to produce the desired output signal in the frequency domain. Data loss resulting from this compression of the spectrum is minimized by linear interpolation across frequencies. The output signal is then converted back into the time domain by means of an inverse FFT (IFFT). One disadvantage of this technique is that it is very inefficient computationally due to the large size of the FFT, and would consume too much electrical energy if implemented in a hearing device. Furthermore, propagation delay of signals processed by this algorithm would be unacceptably long for hearing device users, potentially resulting in some interference with their lip-reading ability. In addition, the compression capabilities (i.e. the range of the compression ratio) are limited due to the applied proportional, i.e. linear, compression scheme.

A feature extraction and signal resynthesis procedure and system based on a vocoder have been described by Thomson CSF, Paris in EP-1 006 511. Information about pitch, voicing, energy, and spectral shape is extracted from the input signal. These features are modified (e.g. by compressing the formant. frequencies in the frequency domain) and then used for synthesis of the output signal by means of-a vocoder (i.e. a relatively efficient electronic or computational device or technique for synthesizing speech signals). A very similar approach has also been described by Strong and Palmer in U.S. Pat. No. 4,051,331. Their signal synthesis is also based on modified speech features. However, it synthesizes voiced components using tones, and unvoiced components using narrow-band noises. Thus, these techniques are spectrum-destroying rather than spectrum-preserving.

A phase vocoder system for frequency transposition is described in a paper by H. J. McDermott and M. R. Dean ("Speech perception with steeply sloping hearing loss", British Journal of Audiology, vol. 34, pp. 353–361, December 2000). A non-real-time implementation is disclosed using a computer program. Digitally recorded speech signals were low pass filtered, down sampled and windowed, and then processed by a FFT. The phase values from successive FFTs were used to estimate a more precise frequency for each FFT bin, which was used to tune an oscillator corresponding to each FFT bin. Frequency lowering was achieved by multiplying the frequency estimates for each FFT-bin by a constant factor.

Another system that can separately compress the frequency range of voiced and unvoiced speech components as well as the fundamental frequency has been described by S. Sakamoto, K. Goto, et. al. ("Frequency Compression Hearing Aid for Severe-To-Profound Hearing Impairments", Auris Nasus Larynx, vol. 27, pp. 327–334, 2000). This system allows independent adjustment of the frequency compression ratio for unvoiced and voiced speech, fundamental frequency, the spectral envelope, and the instrument's frequency response by the selection of different filters. The compression ratio for either voiced or unvoiced speech is adjustable from 10% to 90% in steps of 10%. The fundamental frequency can either be left unmodified, or compressed with a compression ratio either the same as, or lower than, that employed for voiced speech. A problem with each of the above feature-extraction and resynthesis processing schemes is that it is technically extremely difficult to obtain reliable estimates of speech features (such as fundamental frequency and voicing) in a wearable, real-time hearing instrument, especially in unfavorable listening conditions such as when noise or reverberation is present.

EP-0 054 450 describes the transposition and amplification of two or three different bands of the frequency spectrum into lower-frequency bands within the audible range. In this scheme, the number of "image" bands equals the number of original bands. The frequency compression ratio can be different across bands, but is constant within each band. The image bands are arranged contiguously, and transposed to frequencies above 500 Hz. In order to free this part of the spectrum for the image bands, the amplification for frequencies between 500 and 1000 Hz decreases gradually with increasing frequency. Frequencies below 500 Hz in the original signal are amplified with a constant gain.

In U.S. Pat. No. 4,419,544 to Adelman, the input signal is subjected to adaptive noise canceling before filtering into at least two pass-bands takes place. Frequency compression is then carried out in at least one frequency band.

Other techniques described previously include the modulation of tones or noise bands in the low-frequency range based on the energy present in higher frequencies (e.g. FR-1 309 425, U.S. Pat. No. 3,385,937), and various types of linear and non-linear transposition of high-frequency components which are then superimposed onto the low-frequency part of the spectrum (e.g. U.S. Pat. No. 5,077,800 and U.S. Pat. No. 3,819,875). Another approach (WO 00/75 920) describes the superposition of the original input signal with several frequency-compressed and frequency-expanded versions of the same signal to generate an output signal containing several different pitches, which is claimed to improve the perception of sounds by hearing-impaired listeners.

Problems with each of the above described methods for frequency transposition include technical complexity, distortion or loss of information about sounds in some circumstances, and unreliability of the processing in difficult listening conditions, e.g. in the presence of background noise.

SUMMARY OF THE INVENTION

It is therefore an object of the present invention to enable frequency transposition to be carried out more efficiently.

A method for frequency transposition in a communication device or a hearing device, respectively, is disclosed by transforming an acoustical signal into an electrical signal and by transforming the electrical signal from time domain into frequency domain to obtain a spectrum. A frequency transposition is being applied to the spectrum in order to obtain a transposed spectrum, whereby the frequency transposition is being defined by a nonlinear frequency transposition function. Thereby, it is possible to transpose lower frequencies almost linearly, while higher frequencies are transposed more strongly. As a result thereof, harmonic relationships are not distorted in the lower frequency range, and at the same time, higher frequencies can be moved to a lower frequency range, namely to an audible frequency range of the hearing impaired person. The transposition scheme can be applied to the complete signal spectrum without the need for switching between non-transposition and transposition processing for different parts of the signal. Therefore, no artifacts due to switching are encountered. A higher transmission quality is obtained because more information is taken into account for the transmission.

By applying a frequency transposition to the spectrum of the acoustic signal to obtain a transposed spectrum, whereby the frequency transposition is being defined by a nonlinear frequency transposition function (i.e. the compression ratio is a function of the input frequency), it is possible to transpose different frequencies by different amounts, i.e. to let lower frequencies pass without transposition or to apply only a small amount of transposition to them, while higher frequencies are transposed more strongly. As a result thereof, harmonic relationships are not distorted in the lower frequency range, and at the same time, higher frequencies can be moved into a lower frequency range, namely to an audible frequency range of the hearing impaired person. The transposition scheme can be applied to the complete signal spectrum without the need for switching between non-transposition and transposition processing for different parts of the signal. Therefore, no artifacts due to switching are encountered when applying the present invention.

BRIEF DESCRIPTION OF THE DRAWINGS

The present invention is further explained by referring to exemplified embodiments shown in drawings. It is shown in:

FIGS. 6 and 7 two weighting matrices for linear frequency compression or frequency transposition, respectively, according to the present invention;

FIG. 8 a weighting matrix for piecewise linear frequency compression or frequency transposition, respectively, according to the present invention;

DETAILED DESCRIPTION OF SEVERAL EMBODIMENTS

Figure 1:
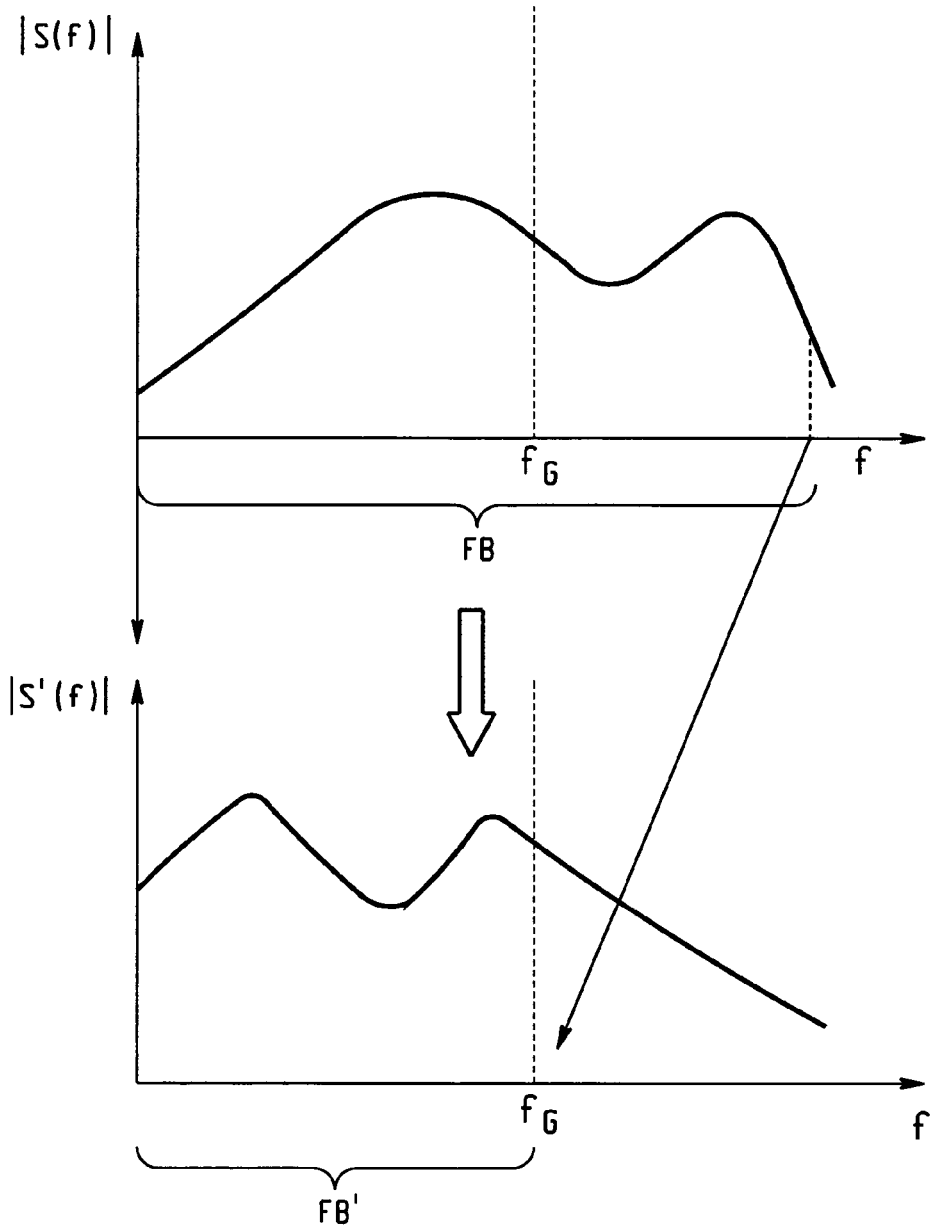
FIG. 1 a magnitude as a function of frequency of an acoustic signal as well as the magnitude as a function of frequency of that signal after transposition.

As has already been mentioned, frequency transposition is a potential means for providing profoundly hearing impaired patients with signals in their residual range. The process of frequency transposition is illustrated in FIG. 1, wherein the magnitude spectrum |S(f)| is shown of an acoustic signal in the upper graph of FIG. 1. A frequency band FB is transposed by a frequency transposition function to obtain a transposed magnitude spectrum |S' (f)| and a transposed frequency band FB'. It is assessed that the hearing ability of the patient is more or less intact in the transposed frequency band FB' whereas in the frequency band FB it is not. Therefore, it is possible by the frequency transposition to image a part of the spectrum from an inaudible into an audible range of the patient. As a measure for the frequency transposition, a so-called compression ratio CR is defined as follows:

$$CR = \frac{FB}{FB'}$$

Figure 3:
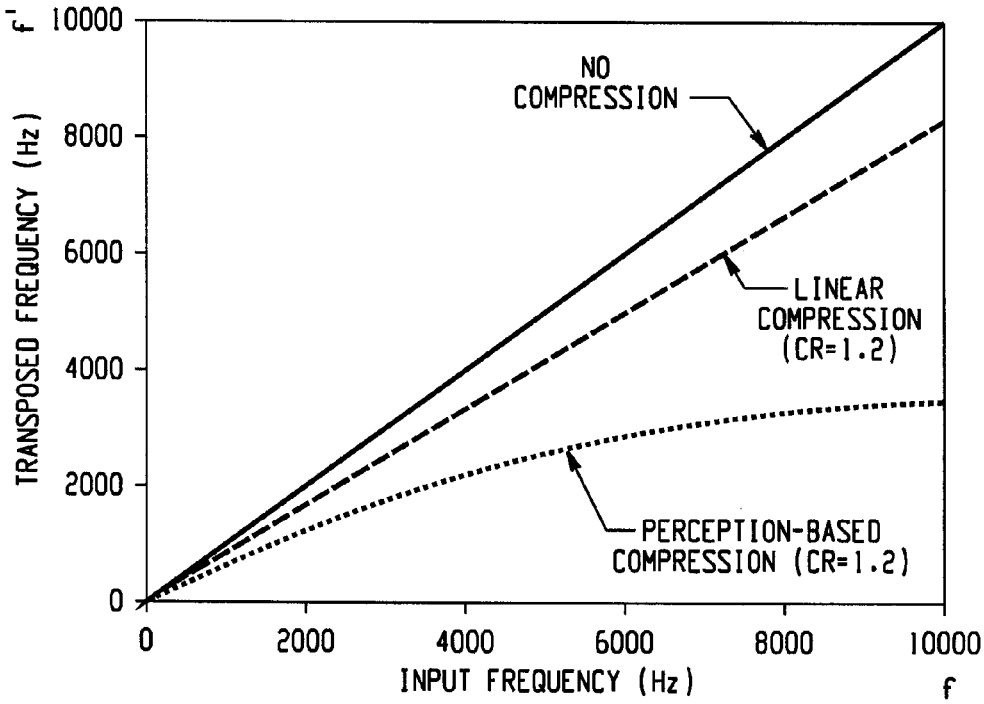
FIGS. 3 and 4 frequency transposition schemes having no compression, linear compression and perception-based compression.
Figure 4:
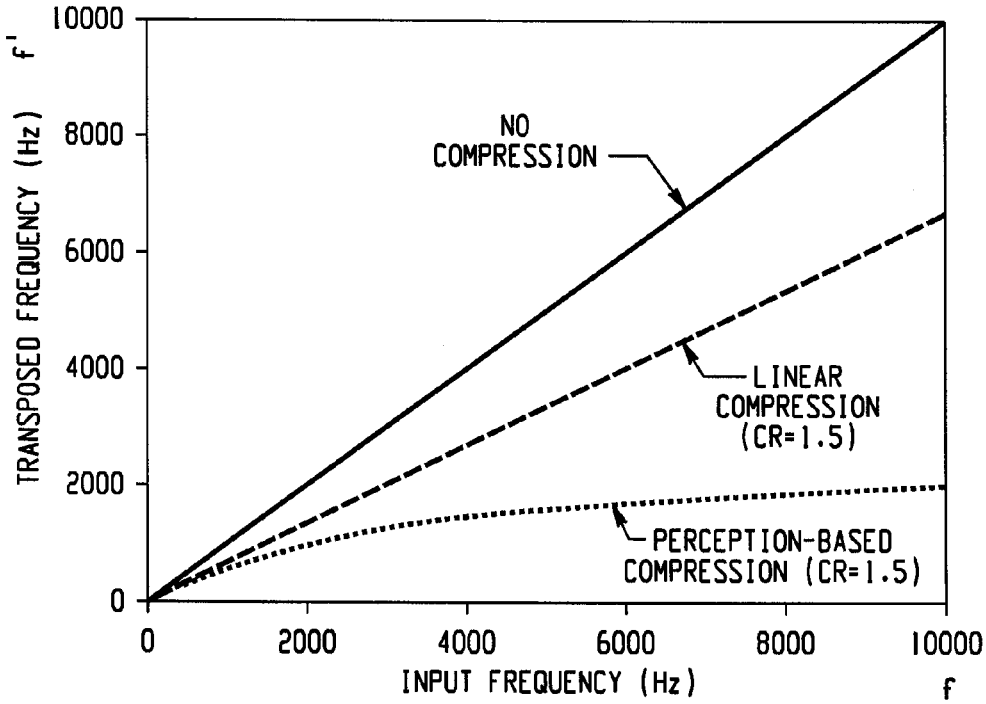

So far, linear or proportional frequency transposition (as it is shown in FIGS. 3 and 4 by the dashed line), or linear frequency transposition applied to only parts of the spectrum of a acoustic signal, are the only meaningful schemes since other processing methods of the state of the art distort the signal in such a manner that potential subjects reject the processing. The application of linear frequency transposition is however limited in that in order to preserve a reasonable intelligibility of the speech signal, the frequency span of the compressed signal should not be less that 60 to 70% of the original bandwidth. This conclusion has been found by C. W. Turner and R. R. Hurtig in the paper entitled "Proportional Frequency Compression of Speech for Listeners with Sensorineural Hearing Loss" (Journal of the Acoustical Society of America, 106(2), pp. 877–886, 1999). The compression ratios are thus limited to values in the range of up to 1.5.

With the above-described limitation, common consonant frequencies lying in the range of 3 to 8 kHz can only be compressed into approximately 2 to 5 kHz. For most hearing impaired patients, however, these frequencies are still poorly audible or not audible at all. The desired benefit of frequency transposition can thus not be achieved.

Nonlinear transposition schemes were not considered so far because the distortion of the harmonic relationships in lower frequencies has a detrimental effect on vowel recognition and is therefore totally unacceptable.

The possibility to overcome the above-mentioned problems has been documented by Sakamoto et. al. (see above): Voiced and unvoiced components of the signal have been distinguished, and the frequency transposition has only been applied to the unvoiced components, Although nonlinear transposition might be suitable in this case because the important low frequent harmonic relationships are not transposed and therefore unchanged, switching between different processing schemes creates audible artifacts as well, and is therefore also disadvantageous. In addition, as mentioned earlier, it is very difficult to achieve the required speech feature recognition with sufficient reliability and robustness.

Figure 2:
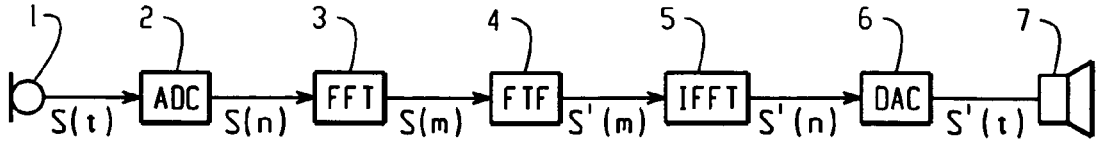
FIG. 2 a block diagram of a hearing device according to the present invention.

FIG. 2 shows a simplified block diagram of a digital hearing device according to the present invention comprising a microphone 1, an analog-to-digital converter unit 2, a transformation unit 3, a signal processing unit 4, an inverse transformation unit 5, a digital-to-analog converter unit 5 and a loudspeaker 7, also called receiver. Of course, the invention is not only suitable for implementation in a digital hearing device but can also readily be implemented in an analog hearing device. In the latter case, the analog-to-digital converter unit 2 and the digital-to-analog converter unit 6 are not necessary.

In a further embodiment of the present invention, instead of the inverse transformation unit 5 a so-called vocoder is used in which the output signal is synthesized by a bank of sine wave generators. For further information regarding the functioning of a vocoder, reference is made to H. J. McDermott and M. R. Dean ("Speech perception with steeply sloping hearing loss", British Journal of Audiology, vol. 34, pp. 353–361, December 2000).

Furthermore, an implementation of the invention is not only limited to conventional hearing devices, such as BTE-(behind the ear), CIC-(completely in the canal) or ITE-(in the ear) hearing devices. An implementation in implantable devices is also possible. For implantable devices, a transducer is used instead of the loudspeaker 7 which transducer is either operationally connected to the signal processing unit 4, or to the inverse transformation unit 5, or to the digital-to-analog converter unit 6, and which transducer is made for directly transmitting acoustical information to the middle or inner ear of the patient. In any case, a direct stimulation of receptor in the inner ear is conceivable by using the output signal of the signal processing unit 4.

In the transformation unit 3, the sampled acoustic signal s(n) is transformed into the frequency domain by an appropriate frequency transformation function in order to obtain the discrete spectrum S(m). In a preferred embodiment of the present invention, a Fast Fourier Transformation is applied in the transformation unit 3. Fur further information, reference is made to the publication of Alan V. Oppenheim and Ronald W. Schafer "Discrete-time Signal Processing" (Printice-Hall Inc., 1989, chapters 8 to 11), Instead of applying the Fourier Transformation in the transformation unit 3, any other suitable transformation can be used, such as for example the Paley, Hadamard, Haar or the slant transformation. For further information regard these transformations, reference is made to Claude S. Lindquist in "Adaptive & Digital Signal Processing" (1989, Steward & Sons, Miami, Fla., Section 2.8).

In the signal processing unit 4, a frequency transposition is being applied to the spectrum S(m) in order to obtain a transposed spectrum S'(m), whereby the frequency transposition is defined by a nonlinear frequency transposition function.

In general, the frequency transposition function must be such that lower frequencies are transposed weakly and essentially linearly, while higher frequencies are transposed more strongly, either in a linear or nonlinear manner. Hence, harmonic relationships are not distorted in the lower frequency range, and, at the same time, higher frequencies can be moved to such low frequencies that they can fall into the audible range of profoundly hearing impaired person. Therefore and in one embodiment of the present invention, a piecewise linear frequency transposition function is applied, wherein at least the part of the frequency transposition function which is sensitive to distortion of harmonic relationship constitutes a linear section.

It is pointed out that frequency compression fitting, and therewith the resulting frequency transposition function, can be described qualitatively as aiming at achieving maximum speech transmission for the available bandwidth, whereby this bandwidth is determined from the audiogram and from speech tests. Frequency compression parameters are a compression ratio above the cut-off frequency, and a cut-off frequency of 1.5 to 2.5 kHz, preferably of 2 kHz. Parameter adjustment is done based on sound quality and speech intelligibility requirements.

In a further embodiment of the present invention, the nonlinear frequency transposition function has a perception-based scale, such as the Bark, ERB or SPINC scale. Regarding Bark, reference is made to E. Zwicker and H. Fastl in "Psychoacoustics—Facts and Models" (2nd edition, Springer, 1999), regarding ERB, reference is made to B. C. J. Moore and B. R. Glasberg in "Suggested formulae for calculating auditory-filter bandwidths and excitation patterns" (J. Acoust. Soc. Am., Vol. 74, no. 3, pp. 750–753, 1983), and regarding SPINC, reference is made to Ernst Terhardt in "The SPINC function for scaling of frequency in auditory models" (Acustika, no. 77, 1992, p.40–42). With these frequency transposition functions, lower frequencies are transposed almost linearly, while higher frequencies are transposed more strongly. Hence, harmonic relationships are not distorted in the lower frequency range, and, at the same time, higher frequencies can be moved into such low frequencies that they can fall into the audible range of profoundly hearing impaired patients. The frequency transposition function can be applied to the complete signal spectrum, without the need for identifying any speech features and switching between non-transposition and transposition processing for different parts of the signal.

In a further embodiment of the present invention, a nonlinear frequency transposition function, such as for example Bark, ERB or SPINC, can be implemented by a piecewise approximation. This can be accomplished, for example, by first, second or higher order approximation.

FIGS. 3 and 4 show different frequency transposition functions and transposition ratios, wherein the horizontal axis represents the input frequency f and the vertical axis represents the corresponding output frequency f'. The graphs drawn by a dotted line represent different frequency transposition functions according to the present invention. The graphs drawn by solid and dashed lines are for comparison and show corresponding state of the art frequency transposition functions.

In FIG. 3, three different transposition schemes are represented in the same graph:

- solid line: no compression, therefore no frequency. transposition;
- dashed line: linear compression with compression ratio CR=1.2;
- dotted line: perception-based compression with compression ratio CR=1.2.

In FIG. 4, again three different transposition schemes are represented in the same graph with the following characteristics:

- solid line: no compression, therefore no frequency transposition (same as in FIG. 3);
- dashed line: linear compression with compression ratio CR=1.5;
- dotted line: perception-based compression with compression ratio CR=1.5.

In a preferred embodiment of the present invention, the SPINC-(spectral pitch increment) compression scheme is implemented by transforming the input frequency f into the SPINC scale Φ, applying the desired compression ratio CR in the SPINC scale, and transforming back to the linear frequency scale. Therefore, the corresponding frequency transposition function can be defined as follows;

$$f' = const \cdot \tan\left(\frac{\Phi'(f)}{const}\right),$$

wherein $$\Phi'(f) = \frac{\Phi(f)}{CR}$$

and $$\Phi(f) = const \cdot \arctan\left(\frac{f}{const}\right)$$

and $$const = 1000 \cdot \sqrt{2}.$$

It goes without saying that similar frequency compression can also be achieved in other perception-based frequency transpositions such as by using the Bark or the ERB scale.

In a further embodiment, the frequency transposition function is stored in a look-up table which is provided in the signal processing unit 4. The look-up table can be easily accessed by the signal processing unit 4.

In the following, an embodiment for the implementation of frequency compression with respect to a FFT bin matrix is explained by referring to FIGS. 5 to 10.

In FFT-based processing, each frequency bin has a certain bandwidth and centre frequency. For example, for a 32 point FFT on a signal sampled with 16 kHz, the bandwidth of each frequency bin is 16'000 Hz/32/2 (looking at positive frequencies only)=250 Hz. The centre frequencies of the individual bins are then spaced 250 Hz apart. The relationships are shown in the following table:

| | bin | | | |
|---|---|---|---|---|
| | 1 | 2 | 3 | 4 |
| centre frequency [Hz] | 0 | 250 | 500 | 750 |
| bandwidth [Hz] | 250 | 250 | 250 | 250 |
| frequency range [Hz] | −125 . . . 125 | 125 . . . 375 | 375 . . . 625 | 625 . . . 875 |

Figure 5:
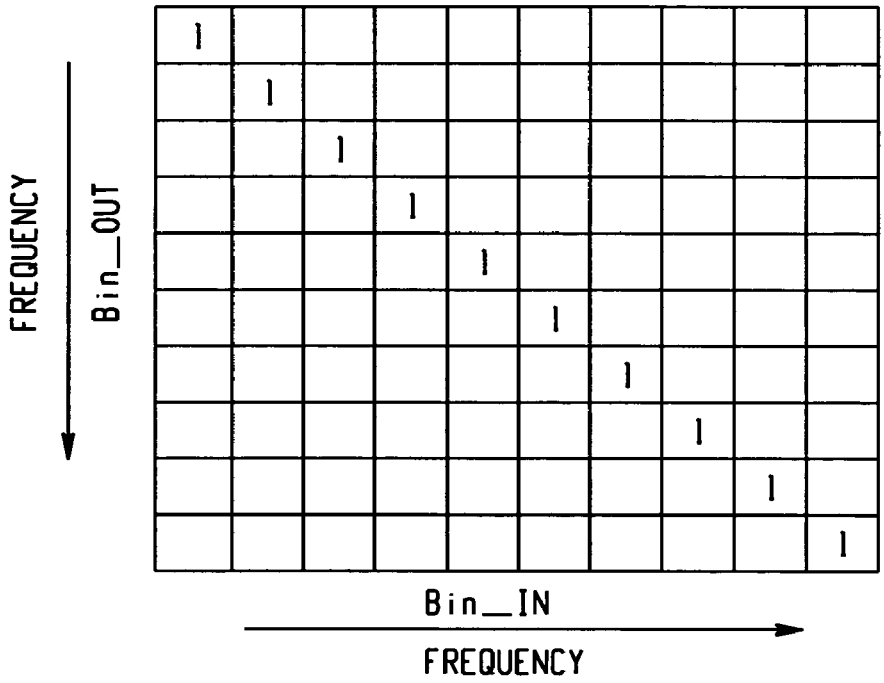
FIG. 5 a weighting matrix with no frequency compression or no frequency transposition, respectively.

FIG. 5 shows a weighting matrix for 1:1 frequency compression (i.e. no frequency compression or frequency transposition, respectively). Its interpretation is as follows: input frequencies falling, for example, into bin 2, i.e. between 125 and 375 Hz, are represented within the output frequency bin 2 with frequencies between 125 and 375 Hz.

For frequency compression, the equation to compute output frequency from input frequency might lead to output frequencies which are not equal to any FFT bin centre frequency. To illustrate this, the following simple example for linear frequency compression given:

$$F_{out} = \frac{1}{3} \cdot F_{in}$$

The centre frequency of input bin 4, for example, then falls exactly onto output bin 2 (⅓*750 Hz=250 Hz), but for input bin 3, for example, the centre frequency falls between output bins 1 and 2 (⅓*500 Hz=167 Hz).

In a first embodiment, the input bin is mapped with a weight of one to the output bin which has centre frequency closest to the calculated transposed frequency. For the above-mentioned example, this would be output bin 2 with centre frequency 250 Hz (167 is closer to 250 than 0).

Figure 6:
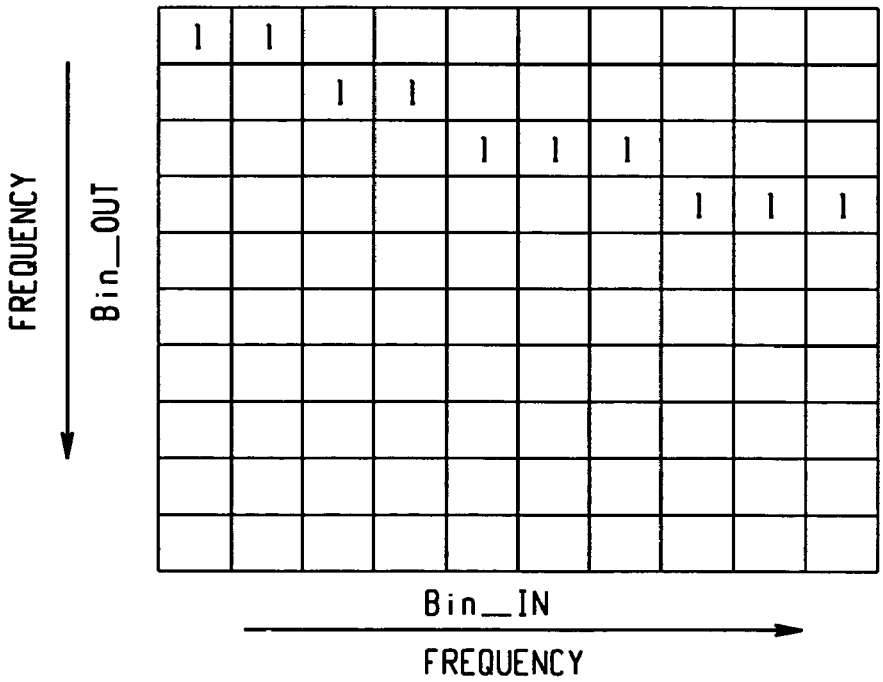

Such a weighing matrix, where always the closest output bin is chosen, is shown in FIG. 6 in which input bin 1 is mapped to output bin 1, input bin 2 is mapped to output bin 1, input bin 3 is mapped to output bin 2, input bin 4 is mapped to output bin 2, input bin 5 is mapped to output bin 3, etc. It is clear that this method is very simple, but it leads to distortions in the output sound. The desired mapping from input to output frequencies cannot be achieved with sufficient resolution.

Therefore, in a further embodiment of the present invention, the input frequency is mapped onto two neighboring output bins with a total weight of 1, where each bin is weighed according to the distance of its centre frequency to the desired output frequency. In the above-mentioned example, input bin 3 with centre frequency 500 Hz is mapped to an output frequency of 167 Hz which lies between output bins 1 and 2. According to the proposed transition matrix, the mapping would be as follows: use output bins 1 and 2 (the desired 167 Hz lie between 0 and 250 Hz) and assign the weight 0.67 to bin 2 (167/250=0.67) and 1−0.67=0.33 to bin 1.

Such a weighing matrix is shown in FIG. 7. Input bin 1 is mapped onto output bin 1 only with weight 1. Input bin 2 is mapped onto output bin 1 with weight 0.9 and output bin 2 with weight 0.1 (i.e. 90% of the signal in input bin 1 is represented in output bin 1 and the remaining 10% in output bin 2). Input bin 3 is mapped onto output bin 2 with weight 0.6 and output bin 3 with weight 0.4 (i.e. 60% of the signal in input bin 3 is synthesized with the centre frequency of output bin 2, and the remaining 40% in output bin 3), etc.

Finally, FIG. 8 shows a further weighting matrix analogous to the one presented in FIG. 7 but for the case of piecewise linear compression (i.e. a practical nonlinear compression scheme) with no compression below the cut-off frequency of 1.5 kHz and linear compression above the cut-off frequency.

Although the various aspects of the present invention have been described in connection with downward frequency shifting, the same applies for upward frequency shifting (expansion) and the various aspects can also be readily applied for any upward frequency shifting. An application where such an upward frequency shifting could be utilized is in the context of mitigating the occlusion effect, also referred to as closure effect, in order to undo the unpleasant dullness of the own voice as it occurs when closing the ear canal with an ITE-(In-The-Ear) hearing device or an ear mold.

In addition, it is expressly pointed out that all aspects of the present invention described above can also be used in connection with communication systems having a limited bandwidth for information transmission. For such communication systems, the same aspect of the present invention can be applied to significantly improve transmission quality. This will be further explained in the following:

For most communication systems, information is transmitted over a limited bandwidth. For example, the audio bandwidth of the telephone network is currently limited to 300 to 3300 Hz. As a result, important parts of speech beyond 3300 Hz are not transmitted very well, especially unvoiced speech sounds such as "S", "SH" and "F".

Other examples are so-called two-way radio systems (e.g. Walkie-Talkies) that are frequently used by police forces, fire fighters, ambulance services, etc. Most of these systems are analog systems with a very limited audio bandwidth (e.g. 2.5 kHz). This makes intelligibility very difficult, especially considering the often adverse listening conditions in which these professionals operate.

Musicians need to hear their own voice or the instrument they are playing. Normally this is either done by placing loudspeakers on stage that amplify the necessary signals for a given musician or by a wireless feedback system. In the latter case, the musician wears a body worn receiver that is connected to an earpiece that delivers the sound to the ear. State of the art analog technology available today would basically allow integration of such a monitoring device into very small communication devices. The objection against this is bandwidth of the transmitted audio signal and the loudspeaker which can be characterized by a 7 kHz bandwidth.

Small communication devices are, for example, of the type "hearing device" as they are marketed by the company Phonak AG. These hearing devices typically consist of a portable module containing a microphone in connection with an FM-(frequency modulation) transmitter that can be placed on a desk or lectern, and an FM receiver which is directly connected to the hearing device itself, usually via a so-called "audio shoe" as adapter. In this way, a hearing device user can remotely listen from a microphone placed close to the source. Current FM systems have an audio bandwidth of 5 to 7 kHz. According to the present invention, frequency compression is used to include information from higher audio frequencies within the same transmission bandwidth. For example, the information of all frequencies up to 10 kHz can be compressed into the available bandwidth by the transmission system.

A further application of the present invention is directed to binaural hearing device systems since one is confronted with similar transmission problems. Besides the limited bandwidth further technical difficulties must be overcome, as for example the size and power consumption while aiming at a high transmission rate.

In all of these applications, better intelligibility and understanding is achieved by the present invention, namely by compressing more information into the available bandwidth as it is described above.

A number of techniques for improving the quality and intelligibility of speech transmitted over narrowband channels have been reported in the literature. U.S. Pat. No. 2,810,787 describes a voiced/unvoiced band switching system. It takes advantage of the fact that the significant energy of voiced sounds occupies the lower portion of the frequency spectrum while the significant energy of unvoiced sounds almost exclusively lies in the high portion of the audible frequency spectrum. Therefore, a voiced-unvoiced detector determines if the instantaneous speech input comprises a voiced or unvoiced sound and based on this decision the available transmission band is allocated to the most relevant portion of the audio spectrum for the particular input sound. A major drawback of this band-switching scheme is that a frequency shift synchronizing signal must be transmitted to the receiver to enable it to correctly restore the original speech signal. DE-31 12 221 A1 and DE-38 07 408 C1 describe methods that do not require such a synchronization signal and employ means to compress the audio signal in the transmitter and expand it again in the receiver. Unfortunately, the rather complicated analog signal processing circuitry limits the possible compression scheme to linear compression with a fixed compression ratio of 1/N, where N is an integer typically with a value of 2 or 3. In the publication entitled "Frequency Compression of 7.6 kHz Speech into 3.3 kHz Bandwidth" by Patrick et al. (IEEE Transactions on Communications; Vol. 31, No. 5, May 1983, pp. 692–701) an adaptive frequency mapping system is proposed. Depending on the characteristics of the momentary speech input, one of four possible compression rules is applied to the signal. This method promises better quality than previous solutions but has the drawback of considerable complexity, especially on the part of the speech analysis block which determines which compression rule to apply.

The present invention uses a simple method of frequency compression or frequency transposition, respectively, for audio signals using frequency domain compression. The resulting time domain audio signal can be transmitted over a narrower band width than the original signal, whilst still preserving audio quality. The frequency compression adjustment can be described qualitatively as aiming to achieve maximum speech transmission for the available bandwidth, whereby this bandwidth is given by the bandwidth of the used communication system.

In general, the available bandwidth is given by the bandwidth provided for information transmission by the communication device. Parameter adjustment is done based on sound quality and speech intelligibility requirements. With careful selection of the appropriate parameters and consideration of the application, de-compression at the receiving end may not be necessary.

In the following, the present invention is described in the context of a telephone network application where de-compression of the signal at the receiving end is possible but not necessary.

A frequency compression device can be built using a digital signal processor and included inside a mobile or a fixed line telephone handset. The frequency compression device receives an analog audio signal, digitizes and processes it as it has already been described along with FIG. 2. If the compression device is to be included in an existing telephone, the signal may be converted back to analog and fed into the normal processing path in the telephone. Alternatively, the frequency compressed signal, which is available in digital form, may be the most suitable for a digital telephone. Many telephones may already contain enough spare signal processing capabilities in the associated signal processing unit to implement the efficient algorithm.

The output signal of the microphone of the telephone is connected to a signal processing unit in which an appropriate window is applied to the sampled audio signal (sampling rate of 16 kHz, for example) before a Fast Fourier Transformation with 32 points, for example, is applied. The resulting frequency spectrum is compressed by combining several high frequency bins into low frequency bins thus compressing more high frequency information into the 300 to 3300 Hz range than previously. The frequency compression is performed in the same manner as has been explained in connection with FIGS. 5 to 8.

In a further embodiment, the time domain signal is obtained by performing an inverse Fast Fourier Transformation (IFFT) on the compressed frequency domain signal. In yet another embodiment of the present invention, the time domain signal is generated by a bank of sine wave oscillators or phase vocoders. The amplitude and frequency control signals for each oscillator are derived from magnitude and phase change values of corresponding FFT bins. Depending on the requirement of the particular telephone, this signal may be converted back to analog, or simply passed on in digital form to the next stage in the telephone.

In a further, more simplified implementation of the present invention, the receiving telephone would not need any modifications or knowledge that frequency compression has been used by the sending or calling telephone. At the receiving telephone, the listener would simply hear a frequency compressed signal. This particular implementation of the present invention allows the use of a frequency compression in any individual telephone, either by hardware/software modifications of an existing telephone, or to be built in to any new telephone. The users outgoing voice quality would be improved and any existing telephone could be used at the receiving end.

In a further implementation of the present invention, the receiving telephone could have a decompression device (yet to be explained) which returns the compressed signal to near original state. However, this implementation requires both the receiving and transmitting telephones to be equipped with frequency compression devices, and also some modifications to the call setup protocol to signal that a compressed signal is being transmitted.

In the following, the present invention is described in the context of the application to FM transmitters used in hearing devices and describes the de-compression process.

The FM transmitter module according to the present invention performs frequency compression as described above, and the compressed signal with an audio bandwidth of 5 kHz is transmitted over the FM link. The hearing device which receives the compressed signal could use it directly, or perform de-compression to restore the signal to its original bandwidth.

If the signal is not to be de-compressed at the receiving end, then it is recommended that frequency compression be implemented with a bin combination that results in the best quality compressed audio signal. This could be implemented with a bin combination matrix similar to the one shown in FIG. 7, with a cut-off frequency at 2 kHz.

However, if the signal is to be de-compressed at the receiving end, then the bin combination matrix used to compress the signal needs to have a corresponding de-compression matrix that provides good reconstruction of the original signal. In this case, the acoustic quality of the compressed signal which is transmitted is not important.

Figure 9:
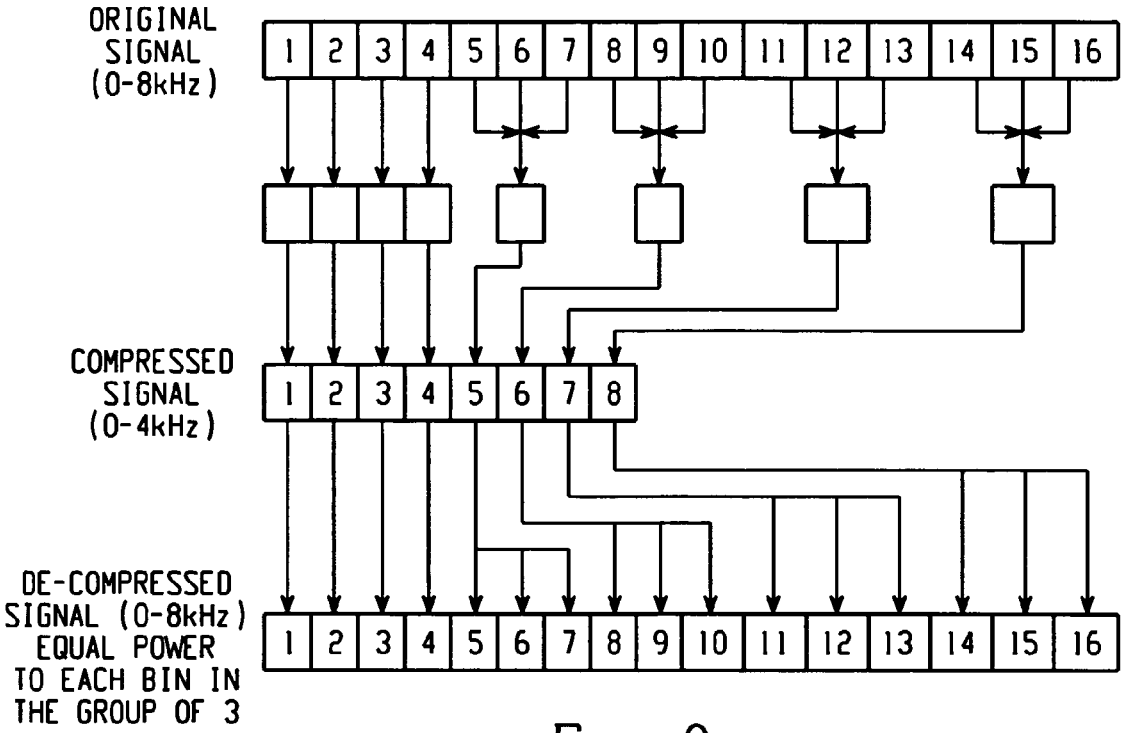
FIG. 9 mapping of frequency bins for compression and de-compression (i.e. expansion) according to the present invention.

In a FM transmission system an audio band 0 to 5 kHz corresponds to an equivalent of 10 FFT bins available for signal transmission (separated at 500 Hz if we assume a typical sampling rate and FFT size). The input signal to be compressed may have a frequency range of 0 to 8 kHz corresponding to 16 FFT bins. The 16 bins must then-be mapped onto 10 bins (or possibly less if a lower audio bandwidth must be obtained). The resulting time domain signal, which need not have any acoustic resemblance to the original signal, is subsequently transmitted. Finally, the signal is reconstructed at the receiving end. Thereby, the rules for bin combination for compression and decompression are outlined below by referring to a specific example:

1) Combine pairs of bins together. Sixteen bins will combine to make eight and map them to bins with frequencies within 0 to 5 kHz (actually eight bins can be transmitted at 0 to 4 kHz). De-compression is performed by splitting the signal in each compressed bin equally between the two bins which contributed to it. Unequal contributions to one compressed bin will not be mirrored in the de-compressed signal.
2) Transmit lower frequencies without compression, and only compress high frequency signals. This is likely to preserve better sound quality in the low frequencies. For example, bins one to four are not compressed and bins five to sixteen are combined in groups of three bins, This makes a total of four non-compressed bins and four compressed bins.

a) De-compression can be performed by splitting the signal of each compressed bin equally between the three contributing bins, as indicated in FIG. 9, b) or by mapping the total signal of each compressed bin all to the centre bin in each set of three. The other two bins in each group would be zero, as indicated in FIG. 10.

3) A compression strategy which combines more bins at higher frequencies than at low frequencies. Combination in groups of odd numbers may be advantageous because de-compression can be performed by mapping the total power of each compressed bin to one frequency bin at the centre of each group of combining bins.

Figure 10:
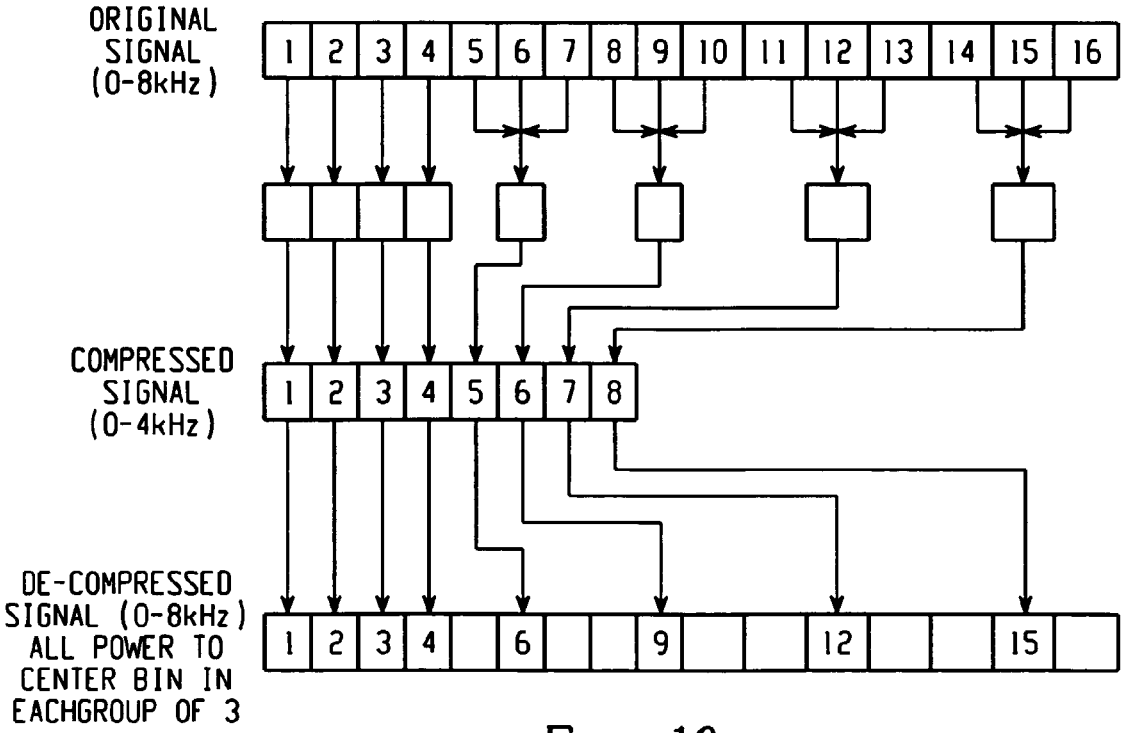
FIG. 10 a further embodiment for a mapping of frequency bins for compression and de-compression (i.e. expansion) according to the present invention.

FIGS. 9 and 10 show, in a graphical representation, a similar mapping of frequency bins for compression and de-compression (i.e. expansion) as has already been described along with the weighting matrices of FIGS. 5 to 8.

While exemplary preferred embodiments of the present invention are described herein with particularity, those skilled in the art will appreciate various changes, additions, and applications other than those specifically mentioned, which are within the spirit of this invention.

The invention claimed is:

1. A method for frequency transposition in a hearing device or in a communication device, respectively, comprising the steps of transforming an acoustical signal into an electrical signal and transforming the electrical signal from time domain into frequency domain to obtain a spectrum, applying a frequency transposition to the entire spectrum in order to obtain a transposed spectrum as an output signal, wherein the frequency transposition is at least partially defined by a nonlinear frequency transposition function and wherein the electrical signal is not superposed with the output signal.

2. The method of claim 1, wherein the nonlinear frequency transposition function is perception-based.

3. The method of claim 1, wherein the nonlinear frequency transposition function is a continuous function.

4. The method of claim 1, wherein the nonlinear frequency transposition function is a piecewise approximation of a continuous function.

5. The method of claim 1, wherein the nonlinear frequency transposition function is a piecewise linear approximation of a continuous function.

6. The method of claim 3, wherein the perception-based frequency transposition function is being defined by one of the following functions: Bark function; ERB function; or SPINC function.

7. The method of claim 1, further comprising the step of applying the transposed spectrum to an output transducer being a receiver or an implantable stimulation device.

8. The method of claim 1, further comprising the step of obtaining the transposed frequency spectrum by using a weighting matrix which is applied to frequency input bins in order to map frequency components onto frequency output bins.

9. The method of claim 8, further comprising the step of mapping an input bin with weight one to an output bin which has a centre frequency closest to an exact calculated transposed frequency.

10. The method of claim 8, further comprising the step of mapping an exact calculated transposed frequency onto neighboring output bins.

11. The method of claim 1, wherein a first communication device is being provided which is at least temporally connected to a second communication device, wherein the transposed spectrum or its corresponding transposed signal, respectively, is being transmitted.

12. The method of claim 11, further comprising the step of de-transposing the transposed spectrum or its corresponding transposed signal, respectively, in the second communication device to restore the electric signal or its corresponding acoustic signal, respectively.

13. A use of the method according to one of the claims 1 to 10 for a link between two hearing device parts of a binaural hearing device.

14. A device comprising at least one microphone, a transformation unit to transform a time domain input signal into a frequency domain output signal, and a signal processing unit, wherein the transformation unit is operationally connected to the at least one microphone and to the signal processing unit, whereas a nonlinear frequency transposition function is applied to the frequency domain output signal of the transformation unit in the signal processing unit and wherein the time domain input signal is not superposed with the frequency domain output signal.

15. The device of claim 14, wherein the nonlinear frequency transposition function is perception-based.

16. The device of claim 14, wherein the nonlinear frequency transposition function is a continuous function.

17. The device of claim 14, wherein the nonlinear frequency transposition function is a piecewise approximation of a continuous function.

18. The device of claim 15, wherein the perception-based frequency transposition function is defined by one of the following functions: Bark function; or ERB function; or SPINC function.

19. The device of claim 14, wherein a look-up table is provided in which the frequency transposition function is defined, the look-up table being either operationally connected to the signal processing unit or being integrated into the signal processing unit, respectively.

20. The device of claim 14, wherein at least one output transducer is operationally connected to the signal processing unit.

21. The device of claim 14, wherein an inverse transformation unit or any other synthesizing means are operationally connected to the signal processing unit.

22. The device of claim 21, wherein at least one output transducer is operationally connected to the inverse transformation unit or to the other synthesizing means.

23. A use of the device of claims 14 in a communication device.

24. A use of the device of claim 14 in a hearing device.

* * * * *

UNITED STATES PATENT AND TRADEMARK OFFICE

CERTIFICATE OF CORRECTION

PATENT NO. : 7,248,711 B2
APPLICATION NO. : 10/794912
DATED : July 24, 2007
INVENTOR(S) : Silvia Allegro et al.

It is certified that error appears in the above-identified patent and that said Letters Patent is hereby corrected as shown below:

Column 1, line 61 through 64: Please delete "$F_{out} = \frac{1}{3} \cdot F_{in}$", and insert therefore --$f' = \frac{1}{3} \cdot f$--.

Signed and Sealed this

Twenty Second Day of April, 2008

JON W. DUDAS
*Director of the United States Patent and Trademark Office*